US007516956B2

(12) United States Patent
Allwright et al.

(10) Patent No.: US 7,516,956 B2
(45) Date of Patent: Apr. 14, 2009

(54) REPOSITIONABLE SHEET SIDE GUIDE AND SHEET SIZE INDICATOR

(75) Inventors: Julia Allwright, London (GB); Andrew K. Balm, Herts (GB); Rebecca Mallaband, West Midlands (GB)

(73) Assignee: Xerox Corporation, Norwalk, CT (US)

( * ) Notice: Subject to any disclaimer, the term of this patent is extended or adjusted under 35 U.S.C. 154(b) by 474 days.

(21) Appl. No.: 11/485,072

(22) Filed: Jul. 12, 2006

(65) Prior Publication Data

US 2008/0012207 A1 Jan. 17, 2008

(51) Int. Cl.
*B65H 1/00* (2006.01)

(52) U.S. Cl. ..... 271/171; 399/393

(58) Field of Classification Search ..... 271/171; 399/393

See application file for complete search history.

(56) References Cited

U.S. PATENT DOCUMENTS 4,032,136 A * 6/1977 Komaba et al. ..... 271/160
4,697,803 A * 10/1987 Kan et al. ..... 271/127
5,188,351 A 2/1993 Gysling
5,313,257 A * 5/1994 Kashima et al. ..... 399/393
5,328,166 A 7/1994 Hukamura
5,360,207 A 11/1994 Rauen et al.
5,511,771 A 4/1996 Rubscha
5,611,528 A 3/1997 Nakamura et al.
5,647,585 A * 7/1997 Cheong ..... 271/171
5,945,527 A 8/1999 Tu et al.
6,302,390 B1 10/2001 Clark et al.
6,775,514 B2 8/2004 Korhonen
6,845,977 B2 1/2005 Leveto et al.
2003/0180078 A1 9/2003 Lynn et al.

* cited by examiner

*Primary Examiner*—Patrick H Mackey
*Assistant Examiner*—Ernesto Suarez
(74) *Attorney, Agent, or Firm*—James J. Ralabate

(57) ABSTRACT

For sheet stacking trays having a lowered sheet stacking position and raised sheet feeding positions, and repositionable stack edge guides, improved visual accuracy for the repositioning of the stack edge guide for different sheet sizes is provided by automatically extending out an elongated visual indicator from the repositionable stack edge guide to closely overlay the correct corresponding stack size visual indicia from a spaced array of such indicia when the tray is in said lowered sheet stacking position, and automatically pivotally lifting this elongated visual indicator up away from any possible obstruction of the raising of the tray for sheet feeding. The indicator may further provide a reading window surrounding the correct indicia.

7 Claims, 4 Drawing Sheets

REPOSITIONABLE SHEET SIDE GUIDE AND SHEET SIZE INDICATOR

By way of background, most printers have sheet stacking trays adapted for stacking different desired sizes of print media sheets. To allow for different sizes of print media sheets to be fed from the same tray, the tray is typically provided with one or more upstanding repositionable stack edge guides (stack side and/or end guides), which are repositionable towards or away from a desired stack edge position to fit the dimensions of the sheets being stacked therein. Correct positioning of stack edge guides for the particular size of the sheets to then be fed from the tray to a printer can be important. Stack lateral or side edge guides typically at least partially control and determine the initial lateral registration and skew of the sheets being fed to the printer from the stack in the tray when the guides are properly positioned contacting or closely adjacent to the stack edges.

Many such sheet stacking trays have linear elongated visual sheet size (sheet dimension) indicia on an attached or imbedded size indicia label adjacent to and parallel the linear movement track of the stack edge guide. Thereby, a finger, pointer or other indicator on the repositioned stack edge guide can point to the then-adjacent sheet size indicia corresponding to that position of the stack edge guide. This system is particularly useful for assisting an operator to properly reposition the stack edge guides before loading a new stack of different size sheets into the stacking tray inside of the stack edge guides. In that situation the stacking tray is usually empty of paper or other print media sheets and thus no sheet stack is in the tray to provide stack edge guides positioning guidance from the sheet stack edges. If the paper size indicator system for the stack edge guides is not correct, the stack edge guides may not be reset in their proper positions for the new stack. That is, properly reset closely adjacent to their respective stack edges but not binding or obstructing the sheets being loaded therein.

There is an additional difficulty in this respect when the sheet stacking tray is of a known type wherein the stack edge guides are mounted to the vertically stationary main body of the tray but the print media sheets are stacked on a pivotal elevate plate. This elevate plate typically overlies and moves upwardly from the main body of the tray when the tray drawer or cassette is inserted and as sheets are fed from the top of the stack on the elevate plate. This allows sheets to feed off of the top of the (variable height) sheet stack by engagement with an overlying sheet feeder-separator in the printer. In such a known system the elevate plate and the sheet stack thereby move up relative to the stack edge guide, and thus the sheet size indicia on the elevate plate moves up relative to the stack edge guide. Allowing that relative movement with ample tolerances to avoid breaking off the indicator finger or other stack edge guide component can require a significant spacing between the stack edge guide and the adjacent elevate plate, and hence an even further significant spacing between the stack edge guide indicator and the sheet size indicia on the elevate plate.

Thus, disclosed in the embodiment herein is a repositionable sheet stack edge guide with an improved sheet stack edge guide visual sheet size indicator system. The exemplary system can provide improved operator visual repositioning indication accuracy even in a sheet feeding tray system in which the stack and the visual sheet size indicator indicia move upwardly to feed sheets therefrom while the sheet stack edge guide remains stationary and the sheet stack edge guide is some distance away from the visual sheet size indicator indicia. In the disclosed embodiment an extended sheet size indicator on the repositionable stack edge guide extends substantially therefrom to closely overlay the then-adjacent but spaced apart sheet size indicia on the elevate plate that is showing the sheet stack size position of the stack edge guide. This can significantly reduce parallax and other reading errors, and thus reduce edge guide positioning errors. Furthermore, in this embodiment this extended sheet size indicator may be pivotally mounted to the edge guide so as to not interfere with the upward movement of the adjacent areas of the elevate plate. Yet this disclosed extended sheet size indicator can be maintained slightly spaced above the sheet size indicia on the elevate plate in its lowered or empty position to avoid contact wear by the sheet size indicator against the sheet size indicia as the stack edge guide is being repositioned.

For further background the following are some examples, in numerical order, from the numerous Xerox Corp. U.S. Patents on various stack edge guides and their movements, incorporated by reference herein: U.S. Pat. Nos. 5,188,351; 5,328,166; 5,360,207; 5,511,771; 5,945,527; 6,302,390 B1; 6,775,514 B2; 6,845,977 B2 and Published Application Publication No. US 2003/0180078 A1 Sep. 25, 2003 to Lynn et al. Also noted is Mita U.S. Pat. No. 5,611,528 issued Mar. 18, 1997 to Nakamura et al.

A specific feature of the specific embodiment disclosed herein is to provide a print media sheets stacking tray with at least one upstanding repositionable stack edge guide which is repositionable in opposite movement directions for different sizes of print media sheets, said print media sheets stacking tray having a main body to which said repositionable stack edge guide is slidably mounted and an elevate plate which overlies and is movable upwardly away from a stack loading position closely overlying said main body of said print media sheets stacking tray, said elevate plate being movable upwardly relative to said stack edge guide and spaced therefrom, and wherein a stack size indicator system is provided by an indicator extending from said stack edge guide pointing to respective stack size indication indicia, which stack size indication indicia extends along said elevate plate adjacent to but spaced from said stack edge guide substantially in said movement directions of said stack edge guide, wherein said indicator is pivotally mounted to said stack edge guide and said indicator is pivotally extendable outwardly from said stack edge guide to directly overlie the adjacent said stack size indication indicia on said elevate plate when said elevator plate is in said stack loading position, and wherein said indicator is pivotal upwardly away from said elevator plate when said elevator plate is moved upwardly away from said stack loading position.

Further specific features disclosed in the embodiment herein, individually or in combination, include those wherein said indicator has an outer portion providing an indicator window through which said adjacent stack size indication indicia on said elevate plate is readable when said stack edge guide directly overlies said adjacent stack size indication indicia on said elevate plate when said elevator plate is in said stack loading position; and/or wherein said indicator is pivotally mounted to said stack edge guide with a pivotal stop which prevents said indicator from directly contacting said stack size indication indicia on said elevate plate but allows said indicator to closely overlie said stack size indication indicia on said elevate plate in said stack loading position; and/or a method of visually indicating the position of a repositionable stack edge guide for a sheet stacking tray, which sheet stacking tray has a lower sheet stacking position and raised sheet feeding positions, comprising; repositioning said stack edge guide to a stack receiving position, automatically pivotally extending an elongated visual indicator from said repositionable stack edge guide out to closely overlay a substantially spaced apart stack size indication visual indicia corresponding to said stack receiving position from an elongated array of such stack size indication visual indicia when said sheet stacking tray is in said lower sheet stacking position, visually confirming from said visual indicator closely overlying said stack size indication visual indicia if said stack edge guide has been repositioned into its desired position, and automatically pivotally lifting said elongated visual indicator away from said elongated array of stack size indication visual indicia when said sheet stacking tray is in said raised sheet feeding positions; and/or wherein said elongated visual indicator has an outer portion providing a reading window surrounding the stack size indication visual indicia corresponding to the repositionable stack edge guide position, which stack size indication visual indicia is visible through said window; and/or wherein said elongated visual indicator extending from said repositionable stack edge guide in said lower sheet stacking position closely overlies but does not touch said stack size indication visual indicia; and/or wherein said elongated visual indicator extending from said repositionable stack edge guide is automatically dropped to closely overlying said stack size indication visual indicia when said sheet stacking tray is lowered from a said raised sheet feeding position.

The term "reproduction apparatus" or "printer" as used herein broadly encompasses various printers, copiers or multifunction machines or systems, xerographic or otherwise. The term "sheet" herein refers to a usually flimsy physical sheet of paper, plastic, or other suitable physical print media substrates for images, whether precut or web fed. The terms tray, sheet tray or paper tray apply to sliding drawers but also cover the alternative terms and various structures of fully removable cassettes.

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular component mountings, component actuations, or component drive systems illustrated herein are merely exemplary, and that the same novel motions and functions can be provided by many other known or readily available alternatives. For example, as shown in the cited and other art, numerous different sheet stacking trays and mounting tracks for the bi-directional repositioning of stack edge guides are known, the present system is not limited to any particular such tray or mounting track, and therefore none need be re-described herein. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example below, and the claims. Thus, they will be better understood from this description of this specific embodiment, including the drawing figures (which are approximately to scale) wherein:

FIG. 1 is a partial perspective view of an exemplary repositionable stack edge guide mounted on the main body of a sheet stacking tray main body rather than the liftable elevator plate on which a stack of sheets may be placed (on the left side of the stack edge guide in this view) showing the pivotal indicator extending from the stack edge guide to closely overlay a corresponding positional indicator indicia on the elevator plate for more accurate reading;

Figure 1:
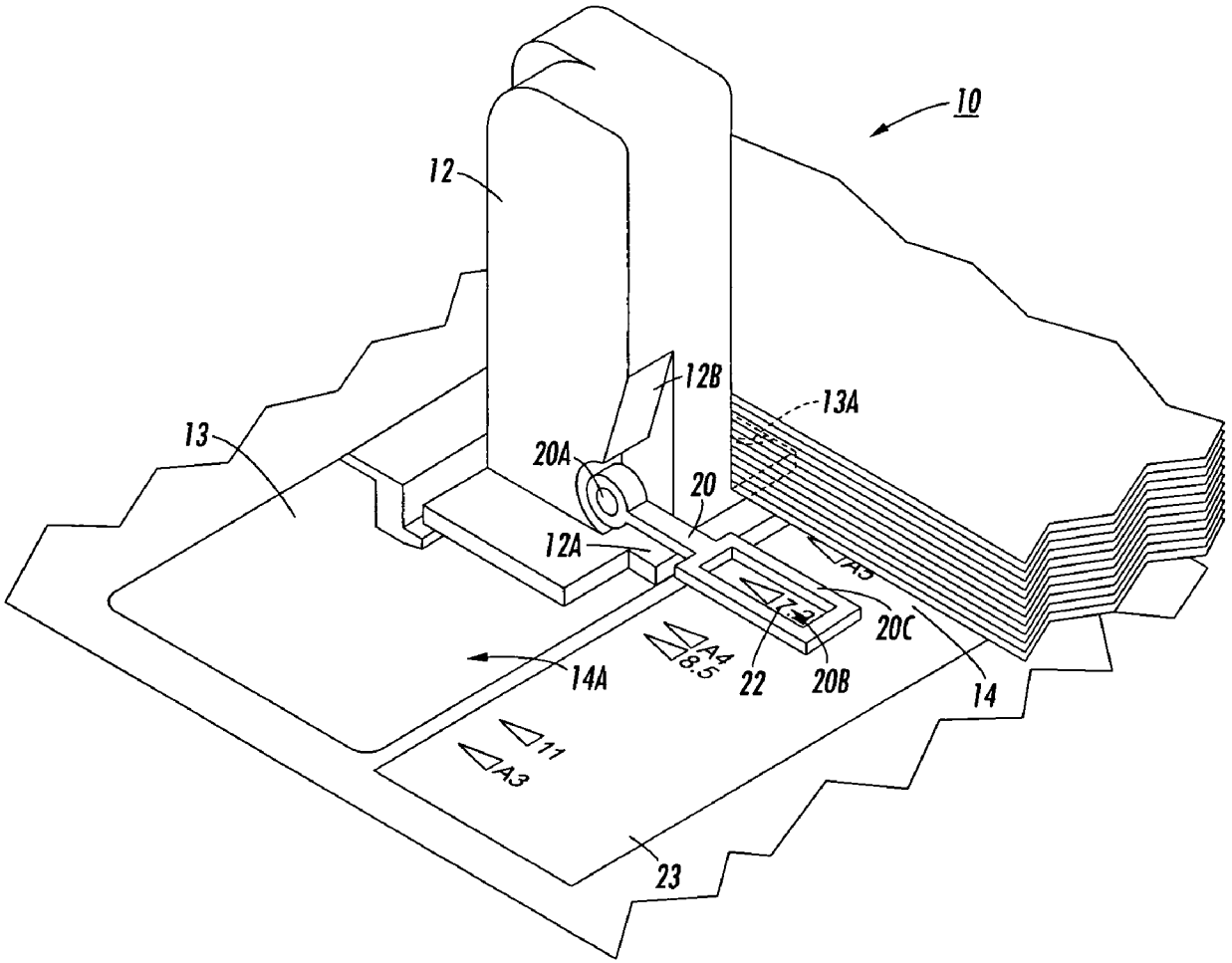

Describing now in further detail the exemplary embodiment with reference to the Figures, there is shown one example of a sheet stacking tray 10 with a repositionable stack edge guide 12 mounted on the non-lifting main body 13 of the sheet stacking tray. The upstanding stack edge guide 12 is repositionable on the tracks 13A in this example within an apertured slot 14A in a liftable surroundingly spaced elevator or elevate plate 14 on which a stack of sheets may be placed on the left side of the stack edge guide 12 in these views.

A pivotal indicator 20 extends from the stack edge guide 12 to closely overlay a corresponding sheet size positional indicator indicia 22 from an array 23 of such indicia on the elevate plate 14 extending parallel to the possible repositioning movement path of the stack edge guide 12. There is a significant distance between the stack edge guide 12 and the corresponding adjacent text or other indicia 22 on the self-adhesive label attached to the elevate plate 14 or other such form of indicia array 23. This distance, due to the significant clearance desired in the apertured slot 14A between these relatively moving parts 14 and 12 and practical manufacturing restrictions can lead to visual confusion and/or misalignment of a normal positional indicator system for a stack edge guide. That in turn can result in skewed sheets being fed from the sheet stacking tray and/or paper jams. The system disclosed in this example improves the visibility and accuracy of the stack edge guide repositioning system, and has other advantages.

Figure 2:
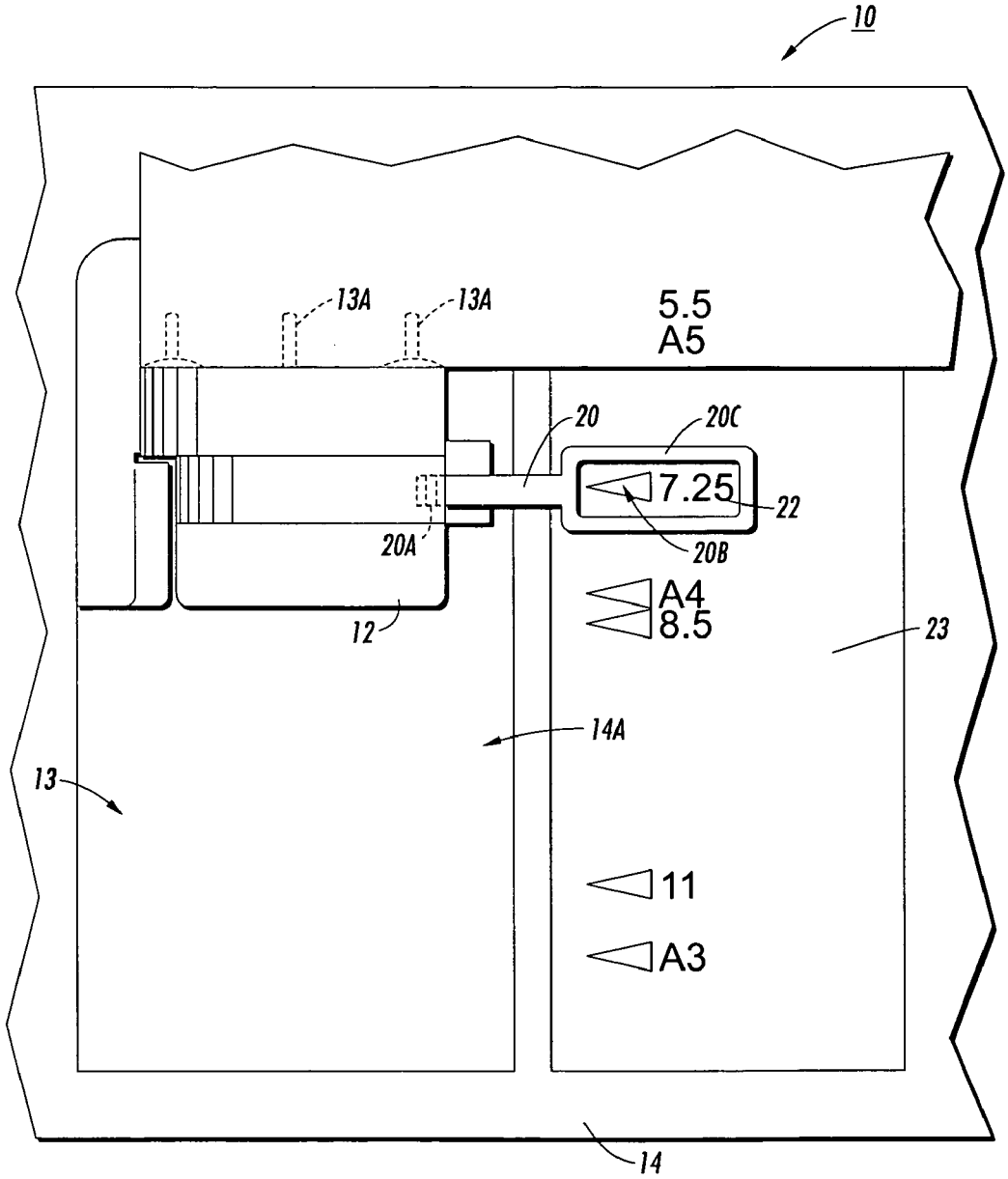
FIG. 2 is a top view of the example of FIG. 1.

The indicator 20 in this example is a separate component pivotally mounted to the stack edge guide 12 to freely rotate about a pivot axis 20A. The outer end of this elongate indicator 20 has an aperture 20B forming an indicator reading window with vertically extending window frames 20C. When the indicator 20 is in an approximately horizontal position, this indicator window is directly over the sheet size indicia 22 to be accurately read by the person resetting the stack edge guide 12, when normally viewed from above, as in FIG. 2. The desired window size will be determined by the text size and position on the indicia array 23.

Figure 3:
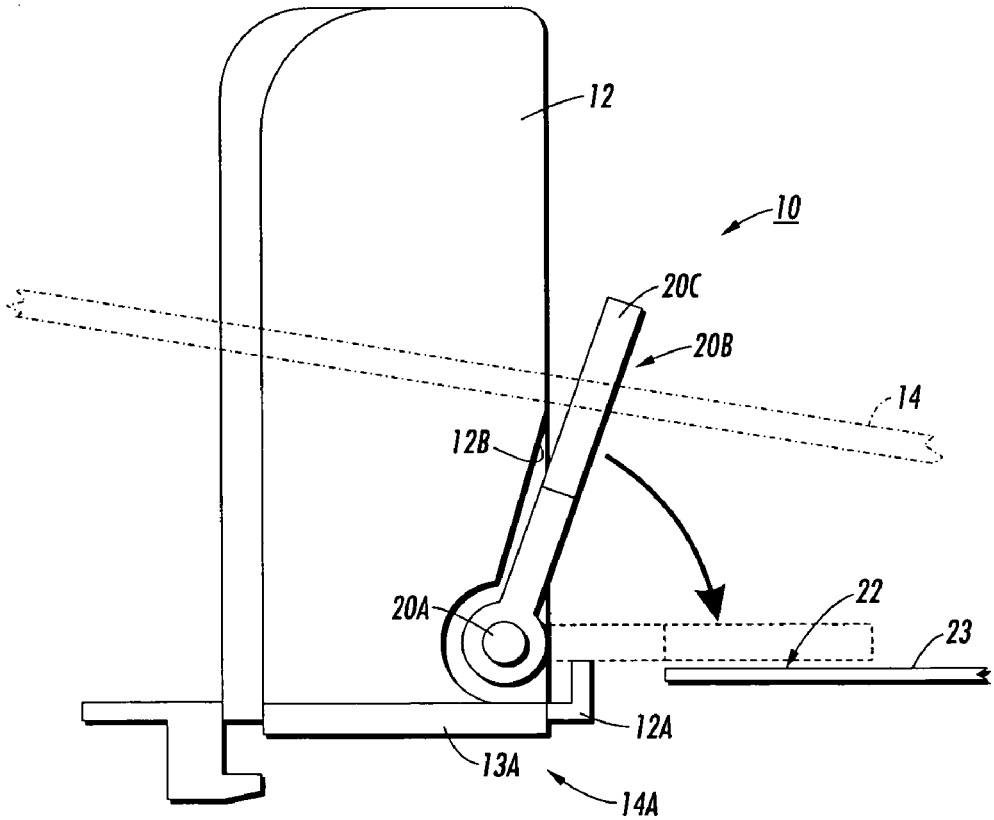
FIG. 3 is an enlarged partial side view of the example of FIGS. 1 and 2 illustrating the exemplary upper positions and the lower stop system position for the pivotal indicator respectively in a sheet feeding position and the lower sheet loading position of the elevator plate.
Figure 4:
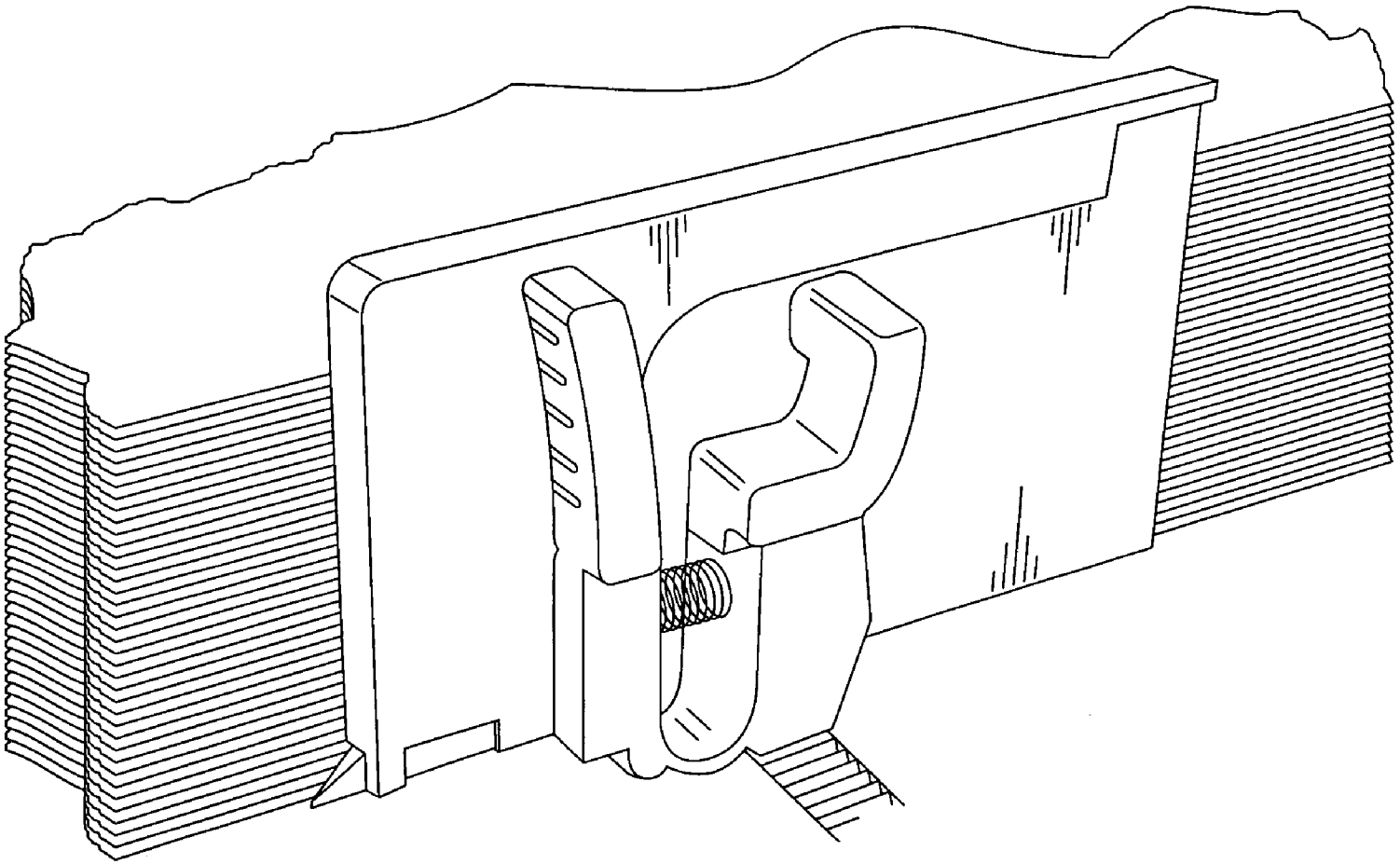
FIG. 4 (PRIOR ART)
FIG. 4 illustrates a prior art stacking tray.

As particularly shown in FIG. 3, and also in FIG. 1, the indicator 20 may be provided with two-pivot angle limiting stops 12A and 12B on the stack edge guide 12. As shown, the lower stop 12A ensures that the indicator 20 stops its downward movement closely spaced horizontally over the size indicia 22 in the stack loading lowered position of the elevate plate 14, but will not contact or rest on any of the size indicia 22. This avoids rubbing and wear damage or removal of any of the indicia 22 in the indicia array 23. The upper stop 12B prevents the indicator 20 from getting stuck in an upright position when it is lifted up by the elevate plate 14 being raised up to a high (low sheet stack height) sheet feeding position to insure the indicator 20 automatically dropping down to the its reading positions of FIGS. 1 and 2 when the elevate plate 14 is lowered for stack edge guide 12 repositioning for a new size of sheet stack being loading on the elevate plate 14. Consideration of the indicator 20 center of gravity could also aid this latter automatic movement.

As also shown in FIG. 3, as the aperture 14A edge of the elevate plate 14 comes into contact with the indicator 20 during its elevation for sheet feeding, the indicator 20 will be automatically pivoted up by that contact about its axis 20A and thus raised along with the elevate plate 14. Thus it avoids obstruction or damage to either component in spite of the length of the indicator 20 provided to reach out to directly overlay the size indicia 22. The length of the indicator 20 is also long enough not to fall through the elevate plate clearance aperture 14A at the maximum elevation angle of the elevate plate 14.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. In a print media sheets stacking tray with at least one upstanding repositionable stack edge guide which is repositionable in opposite movement directions for different sizes of print media sheets, said print media sheets stacking tray having a main body to which said repositionable stack edge guide is slidably mounted and an elevate plate which overlies and is movable upwardly away from a stack loading position closely overlying said main body of said print media sheets stacking tray, said elevate plate being movable upwardly relative to said stack edge guide and spaced therefrom, and wherein a stack size indicator system is provided by an indicator extending from said stack edge guide pointing to respective stack size indication indicia, which stack size indication indicia extends along said elevate plate adjacent to but spaced from said stack edge guide substantially in said movement directions of said stack edge guide, wherein said indicator is pivotally mounted to said stack edge guide and said indicator is pivotally extendable outwardly from said stack edge guide to directly overlie the adjacent said stack size indication indicia on said elevate plate when said elevator plate is in said stack loading position, and wherein said indicator is pivotal upwardly away from said elevator plate when said elevator plate is moved upwardly away from said stack loading position.

2. The print media sheets stacking tray with at least one upstanding repositionable stack edge guide of claim 1, wherein said indicator has an outer portion providing an indicator window through which said adjacent stack size indication indicia on said elevate plate is readable when said stack edge guide directly overlies said adjacent stack size indication indicia on said elevate plate when said elevator plate is in said stack loading position.

3. The print media sheets stacking tray with at least one upstanding repositionable stack edge guide of claim 1, wherein said indicator is pivotally mounted to said stack edge guide with a pivotal stop which prevents said indicator from directly contacting said stack size indication indicia on said elevate plate but allows said indicator to closely overlie said stack size indication indicia on said elevate plate in said stack loading position.

4. A method of visually indicating the position of a repositionable stack edge guide for a sheet stacking tray, which sheet stacking tray has a lower sheet stacking position and raised sheet feeding positions, comprising;

repositioning said stack edge guide to a stack receiving position, automatically pivotally extending an elongated visual indicator from said repositionable stack edge guide out to closely overlay a substantially spaced apart stack size indication visual indicia corresponding to said stack receiving position from an elongated array of such stack size indication visual indicia when said sheet stacking tray is in said lower sheet stacking position, visually confirming from said visual indicator closely overlying said stack size indication visual indicia if said stack edge guide has been repositioned into its desired position, and automatically pivotally lifting said elongated visual indicator away from said elongated array of stack size indication visual indicia when said sheet stacking tray is in said raised sheet feeding positions.

5. The method of visually indicating the position of a repositionable stack edge guide for a sheet stacking tray of claim 4, wherein said elongated visual indicator has an outer portion providing a reading window surrounding the stack size indication visual indicia corresponding to the repositionable stack edge guide position, which stack size indication visual indicia is visible through said window.

6. The method of visually indicating the position of a repositionable stack edge guide for a sheet stacking tray of claim 4, wherein said elongated visual indicator extending from said repositionable stack edge guide in said lower sheet stacking position closely overlies but does not touch said stack size indication visual indicia.

7. The method of visually indicating the position of a repositionable stack edge guide for a sheet stacking tray of claim 4, wherein said elongated visual indicator extending from said repositionable stack edge guide is automatically dropped to closely overlying said stack size indication visual indicia when said sheet stacking tray is lowered from a said raised sheet feeding position.

* * * * *